US011014859B2

(12) United States Patent
Nielson et al.

(10) Patent No.: US 11,014,859 B2
(45) Date of Patent: May 25, 2021

(54) COMPOSITIONS USABLE AS FLARE COMPOSITIONS, COUNTERMEASURE DEVICES CONTAINING THE FLARE COMPOSITIONS, AND RELATED METHODS

(71) Applicant: Northrop Grumman Systems Corporation, Falls Church, VA (US)

(72) Inventors: Daniel B. Nielson, Tremonton, UT (US); Curtis W. Fielding, Hyrum, UT (US)

(73) Assignee: Northrop Grumman Systems Corporation, Plymouth, MN (US)

( * ) Notice: Subject to any disclaimer, the term of this patent is extended or adjusted under 35 U.S.C. 154(b) by 0 days.

(21) Appl. No.: 16/265,857

(22) Filed: Feb. 1, 2019

(65) Prior Publication Data

US 2019/0169082 A1 Jun. 6, 2019

Related U.S. Application Data

(63) Continuation-in-part of application No. 16/208,840, filed on Dec. 4, 2018, now Pat. No. 10,479,738, (Continued)

(51) Int. Cl.
*C06B 43/00* (2006.01)
*C06C 15/00* (2006.01)
(Continued)

(52) U.S. Cl.
CPC ..... *C06B 43/00* (2013.01); *C06B 21/0058* (2013.01); *C06B 27/00* (2013.01);
(Continued)

(58) Field of Classification Search
CPC ..... C06B 43/00; C06B 27/00; C06C 15/00; F42B 4/26; F42B 4/00; F42B 4/28; F42B 4/30
See application file for complete search history.

(56) References Cited

U.S. PATENT DOCUMENTS 3,976,610 A 8/1976 Morris et al.
5,026,814 A * 6/1991 Re ..... C08G 18/10 428/844.7
(Continued)

FOREIGN PATENT DOCUMENTS

AU 2013206584 B2 2/2014
EP 0316891 A2 5/1989
(Continued)

OTHER PUBLICATIONS

"Solvay Solexis presents fluorinated polymer modifiers", Additives for Polymers, Elsevier Advanced Technology, GB, vol. 2009, No. 10, Oct. 1, 2009 (Oct. 1, 2009), p. 4.
(Continued)

*Primary Examiner* — Stephen Johnson
(74) *Attorney, Agent, or Firm* — TraskBritt

(57) ABSTRACT

A composition that includes a fuel and a perfluoropolyether (PFPE) is disclosed. The composition may be used as a flare composition in a countermeasure device. Countermeasure devices including the flare composition are also disclosed, as are methods of forming grains of the countermeasure device.

20 Claims, 3 Drawing Sheets

Related U.S. Application Data which is a continuation of application No. 14/553,785, filed on Nov. 25, 2014, now Pat. No. 10,173,944.

(60) Provisional application No. 62/064,910, filed on Oct. 16, 2014.

(51) Int. Cl.

| | |
|---|---|
| ***C06B 27/00*** | (2006.01) |
| ***F42B 4/26*** | (2006.01) |
| ***C06B 21/00*** | (2006.01) |
| ***F42B 4/30*** | (2006.01) |

(52) U.S. Cl.

CPC ..... *C06C 15/00* (2013.01); *F42B 4/26* (2013.01); *F42B 4/30* (2013.01)

(56) References Cited

U.S. PATENT DOCUMENTS

| | | | |
|---|---|---|---|
| 5,049,213 | A | 9/1991 | Chan et al. |
| 5,268,405 | A | 12/1993 | Ojakaar et al. |
| 5,467,714 | A | 11/1995 | Lund et al. |
| 5,470,408 | A | 11/1995 | Nielson et al. |
| 5,531,844 | A | 7/1996 | Brown et al. |
| 5,574,248 | A | 11/1996 | Brown et al. |
| 5,679,921 | A | 10/1997 | Hahn et al. |
| 5,834,680 | A | 11/1998 | Nielson et al. |
| 5,886,293 | A | 3/1999 | Nauflett et al. |
| 6,312,625 | B1 | 11/2001 | Nielson et al. |
| 6,635,130 | B2 | 10/2003 | Koch |
| 6,896,751 | B2 | 5/2005 | Posson et al. |
| 7,695,820 | B2 | 4/2010 | Economy et al. |
| 7,977,420 | B2 | 7/2011 | Nielson et al. |
| 8,070,710 | B2 | 12/2011 | Dougherty, Jr. |
| 8,247,633 | B2 | 8/2012 | Knupp et al. |
| 8,813,649 | B1 | 8/2014 | Herbage et al. |
| 9,133,071 | B2 | 9/2015 | Hahma |
| 9,139,487 | B2 | 9/2015 | Hahma |
| 10,173,944 | B2 | 1/2019 | Nielson et al. |
| 2005/0183803 | A1 | 8/2005 | Akester et al. |
| 2007/0272112 | A1 | 11/2007 | Nielson et al. |
| 2010/0187469 | A1 | 7/2010 | Srinivasan et al. |
| 2012/0028022 | A1 | 2/2012 | Brugger et al. |
| 2012/0291654 | A1 | 11/2012 | Wilson et al. |
| 2013/0337260 | A1* | 12/2013 | Tapio ..... G02B 1/10 428/355 AC |
| 2014/0034197 | A1 | 2/2014 | Sippel et al. |
| 2016/0194574 | A1 | 7/2016 | Gross et al. |
| 2016/0201005 | A1* | 7/2016 | Nowak ..... C10M 169/041 508/552 |

FOREIGN PATENT DOCUMENTS

| | | | |
|---|---|---|---|
| EP | 1116759 | A1 | 7/2001 |
| EP | 2695871 | A2 | 2/2014 |

OTHER PUBLICATIONS

Solvay Solexis Product Data Sheet for Fluorolink (Registered) Polymer Modifiers, modified Dec. 13, 2002, 5 pages.

Solvay Solexis Product Data Sheet for Fluorolink (Registered) E10-H, 2005, 2 pages.

Rider K B et al: "Thermal analysis of magnesium/perfluoropolyether pyrolants", Propellants, Explosives, Pyrotechnics Jun. 2013 WILEY-VCH VERLAG DEU, vol. 38, No. 3, Jun. 2013 (Jun. 2013), pp. 433-440.

Miller H A et al: "Metastable nanostructured metallized fluoropolymer composites for energetics", Journal of Materials Chemistry A Jun. 28, 2013 Royal Society of Chemistry GBR, vol. 1, No. 24, Jun. 28, 2013 (Jun. 28, 2013), pp. 7050-7058.

Koch; "Pyrotechnic Countermeasures: II. Advanced Aerial Infrared Countermeasures," Propellants, Explosives Pyrotechnics, vol. 31, No. 1, 2006, pp. 3-19.

Functionalized PFPE Fluids, Cornerstone Technology, Inc. copyright 2009.

International Search Report for International Application No. PCT/US2015/054199, dated Feb. 16, 2016, 4 pages.

Written Opinion of the International Search Authority for International Application No. PCT/US2015/054199, dated Feb. 16, 2016, 8 pages.

* cited by examiner

COMPOSITIONS USABLE AS FLARE COMPOSITIONS, COUNTERMEASURE DEVICES CONTAINING THE FLARE COMPOSITIONS, AND RELATED METHODS

CROSS-REFERENCE TO RELATED APPLICATIONS

This application is a continuation-in-part of U.S. patent application Ser. No. 16/208,840, filed Dec. 4, 2018, now U.S. Pat. No. 10,479,738, issued Nov. 19, 2019, which is a continuation of U.S. patent application Ser. No. 14/553,785, filed Nov. 25, 2014, now U.S. Pat. No. 10,173,944, issued Jan. 8, 2019, each of which claims the benefit of U.S. Provisional Patent Application Ser. No. 62/064,910, filed Oct. 16, 2014 and the disclosure of each of which is hereby incorporated herein in its entirety by this reference.

BACKGROUND

Flares are pyrotechnic devices designed and configured to emit intense electromagnetic radiation at wavelengths in the visible region (i.e., visible light), the infrared (IR) region (i.e., heat), or both, of the electromagnetic radiation spectrum without exploding or producing an explosion. Conventionally, flares have been used for signaling, illumination, and defensive countermeasure in civilian and military applications. Decoy flares are one type of flare used in military applications for defensive countermeasures. When an aircraft detects that a heat-seeking missile is in pursuit, the decoy flare is used as protection against the heat-seeking missile. The heat-seeking missile is designed to track and follow the target aircraft by detecting the IR emissions of engines of the target aircraft. The decoy flare is launched from the target aircraft and ignited to produce IR radiation that mimics the IR emissions of the engines of the target aircraft. The IR emissions of the decoy flare are produced by combustion of a flare composition that is conventionally referred to as the "grain" of the decoy flare. The IR emissions of the combusting flare composition are intended to confuse the heat-seeking missile, causing the heat-seeking missile to turn away from the target aircraft and toward the decoy flare.

Conventional flare compositions in a decoy flare include magnesium, TEFLON®, and VITON® (MTV) composition. MTV compositions are conventionally prepared by processes that use flammable solvents to dissolve and precipitate the VITON®. The MTV compositions are also prepared with high shear mix equipment, such as a Muller mixer. The solvents must subsequently be removed, such as by a drying (e.g., solvent evaporation) process, before forming the MTV compositions into grains. The dried MTV compositions are then pressed or extruded at high pressures and cut to length or machined to form the grains. Conventional MTV compositions are highly reactive to energy inputs, such as electrostatic discharge (ESD), impact, and friction. Thus, the processes (use of flammable solvents and ESD sensitivity of flashing remnants from pressing, extrusion, and machining operations) for forming the MTV compositions have safety issues and are time intensive.

BRIEF SUMMARY

Disclosed is an embodiment of a composition comprising a fuel, a perfluoropolyether (PFPE), and a curative. The PFPE has a chemical structure of $HO(CH_2CH_2O)_n CH_2CF_2O(CF_2CF_2O)_p(CF_2O)_qCF_2CH_2(OCH_2CH_2)_nOH$ and a fluorine content of about 57%, where n is an integer between 0 and 10, p is an integer between 0 and 50, and q is an integer between 0 and 5.

Also disclosed is another embodiment of a composition comprising an alloy of magnesium and aluminum and a PFPE. The PFPE has a chemical structure of $HO(CH_2CH_2O)_nCH_2CF_2O(CF_2CF_2O)_p(CF_2O)_qCF_2CH_2(OCH_2CH_2)_nOH$ and a fluorine content of about 57%, where n is an integer between 0 and 10, p is an integer between 0 and 50, and q is an integer between 0 and 5.

A countermeasure device is also disclosed. The countermeasure device comprises a casing and a flare composition contained in the casing. The flare composition comprises a fuel and a PFPE.

A method of forming grains of a countermeasure device is also disclosed. The method comprises forming a flare composition comprising magnesium and a fluoropolymer, and casting the flare composition into grains.

Another embodiment of a composition comprising a fuel, a perfluoropolyether (PFPE), and an isocyanate compound is disclosed. The PFPE comprises a chemical structure of $R_H—CF_2O—(CF_2CF_2O)_m—(CF_2O)_n—CF_2—R_H$, wherein $R_H$ is a functional group selected from the group consisting of an acrylate, an alcohol, an alkyl amide, an alkoxy silane, an amide, an amido silane, an ester, an ethoxylated alcohol, a (meth)acrylate, a phosphate, and a phosphate dispersion, m is an integer between 1 and 50, and n is an integer between 1 and 50. The PFPE comprises from about 15% by weight (wt %) to about 45 wt % of the composition.

Yet another embodiment of a composition comprising a fuel, a perfluoropolyether (PFPE), and an isocyanate compound is disclosed. The PFPE comprises a chemical structure of $HOCH_2CFCF_3OCF_2CF_2CF_2CF_2CH_2CF_2OCF_2CF_2OCF_3CFCF_2OCF_3—CFCF_2OCF_3CFCH_2OH$ and comprises from about 15 wt % to about 45 wt % of the composition.

A countermeasure device is also disclosed. The countermeasure device comprises a casing and a flare composition within the casing. The flare composition comprises a fuel, a perfluoropolyether (PFPE), and an isocyanate compound. The PFPE comprises a chemical structure of $R_H—CF_2O—(CF_2CF_2O)_m—(CF_2O)_n—CF_2—R_H$, wherein $R_H$ is a functional group selected from the group consisting of an acrylate, an alcohol, an alkyl amide, an alkoxy silane, an amide, an amido silane, an ester, an ethoxylated alcohol, a (meth) acrylate, a phosphate, and a phosphate dispersion, m is an integer between 1 and 50, and n is an integer between 1 and 50. The PFPE comprises from about 15% by weight (wt %) to about 45 wt % of the flare composition.

A method of forming grains of a countermeasure device is also disclosed. The method comprises forming a flare composition comprising a fuel, an isocyanate compound, and a perfluoropolyether (PFPE). The PFPE comprises a chemical structure of $R_H—CF_2O—(CF_2CF_2O)_m—(CF_2O)_n—CF_2—R_H$, wherein $R_H$ is a functional group selected from the group consisting of an acrylate, an alcohol, an alkyl amide, an alkoxy silane, an amide, an amido silane, an ester, an ethoxylated alcohol, a (meth)acrylate, a phosphate, and a phosphate dispersion, m is an integer between 1 and 50, and n is an integer between 1 and 50. The PFPE comprises from about 15% by weight (wt %) to about 45 wt % of the flare composition. The flare composition is cast into grains.

DETAILED DESCRIPTION

Figure 1:
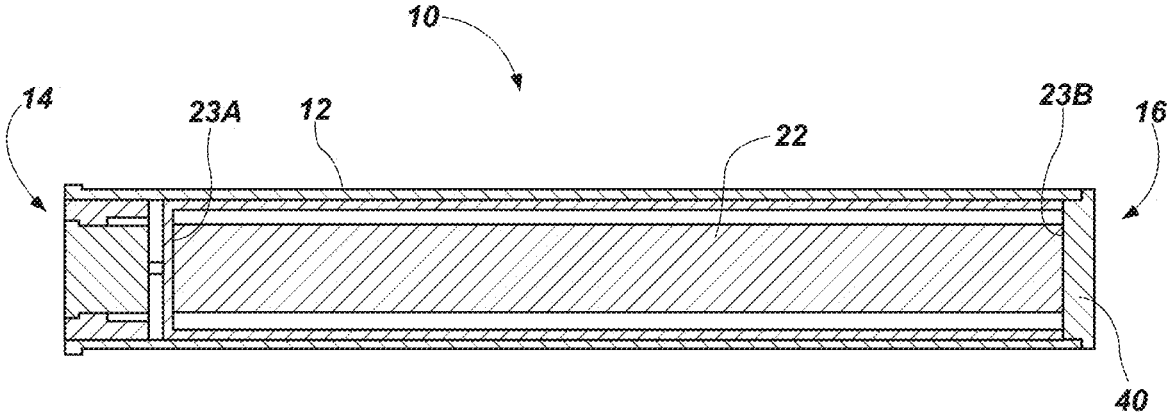
FIG. 1 is a cross-sectional view of a flare including a grain formed from a composition according to an embodiment of the disclosure.

A composition for use as a flare composition is disclosed. The composition includes a fuel, a perfluoropolyether (PFPE), and a curative. The composition may be used in a flare, such as in a decoy flare. As used herein, the term "decoy flare" means and includes a countermeasure decoy having an infrared (IR) output designed to confuse, decoy, or otherwise defeat a heat-seeking missile. The compositions of embodiments of the disclosure, when ignited, may exhibit comparable or improved effectiveness at defeating heat-seeking missiles compared to conventional MTV (magnesium, TEFLON® (polytetrafluoroethylene), and VITON® (a copolymer of vinylidenefluoride and hexafluoropropylene)) compositions. Flares including the composition are also disclosed. In use and operation, the flare containing the composition according to embodiments of the disclosure may exhibit comparable or improved energetic performance, such as a desired IR intensity, burn time, and rise time, compared to a conventional MTV composition. Methods of forming the composition into grains to be used in the flare are also disclosed. The composition may be cast into grains having complex geometries. Casting of the composition enables the grains to be formed with improved safety, processing, and aging properties compared to the formation of grains from conventional MTV compositions.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

The fuel in the composition may be a metal, such as aluminum, bismuth, copper, iron, hafnium, magnesium, nickel, palladium, tantalum, tin, titanium, zinc, zirconium, or an alloy thereof. In some embodiments, the fuel is magnesium. Boron, phosphorous, or silicon may also be used as the fuel, alone or in combination with the metal or alloy thereof. The fuel in the composition may be an alloy of aluminum and magnesium, aluminum and silicon, aluminum and zirconium, boron and zirconium, magnesium and boron, titanium and aluminum, or titanium and boron. Boron, if present in the composition, may also function as a burn rate catalyst. In one embodiment, the fuel is an alloy of magnesium and aluminum. The relative amounts of magnesium and aluminum in such an alloy may be selected depending on the desired IR output of the composition. In another embodiment, the fuel is an alloy of magnesium and aluminum and includes 50% by weight of magnesium and 50% by weight of aluminum. However, other relative amounts of magnesium and aluminum may be used. Alloys of magnesium and aluminum are commercially available from numerous sources, such as from Reade Advanced Materials (Reno, Nev.). The fuel may be a powder having a particle size of from about 5 μm to about 100 μm.

The fuel may be present in the composition at from about 10% by weight (wt %) to about 70 wt %, such as from about 10% wt % to about 50 wt %, from about 10% wt % to about 40 wt %, from about 10% wt % to about 30 wt %, from about 20% wt % to about 70 wt %, from about 20% wt % to about 65 wt %, from about 45% wt % to about 70 wt %, from about 50% wt % to about 70 wt %, from about 55 wt % to about 65 wt %, from about 56 wt % to about 60 wt %, from about 57 wt % to about 60 wt %, from about 58 wt % to about 60 wt %, or from about 59 wt % to about 60 wt %. In one embodiment, the fuel is present in the composition at about 60 wt %. If the fuel includes magnesium, the fuel may be present in the composition at from about 20 wt % to about 65 wt %. If the fuel includes 50% by weight of magnesium and 50% by weight of aluminum, the fuel may be present in the composition at from about 20 wt % to about 65 wt %. If the fuel includes titanium, the fuel may be present in the composition at from about 10 wt % to about 50 wt %. If the fuel includes zirconium, the fuel may be present in the composition at from about 20 wt % to about 70 wt %. If the fuel includes hafnium, the fuel may be present in the composition at from about 20 wt % to about 70 wt %. If the fuel includes aluminum, the fuel may be present in the composition at from about 20 wt % to about 65 wt %. If the fuel includes silicon, the fuel may be present in the composition at from about 10 wt % to about 40 wt %. If the fuel includes phosphorus, the fuel may be present in the composition at from about 10 wt % to about 40 wt %. If the fuel includes boron, the fuel may be present in the composition at from about 10 wt % to about 30 wt %. If the fuel includes zinc, the fuel may be present in the composition at from about 20 wt % to about 65 wt %. If the fuel includes tin, the fuel may be present in the composition at from about 20 wt % to about 65 wt %.

The PFPE in the composition may be a fluorinated ethoxylated diol having a high fluorine content, such as a dihydroxy functionalized monomeric, oligomeric, or polymeric PFPE. The PFPE is a liquid at room temperature (from about 22° C. to about 25° C.) and at a processing temperature of the composition. The PFPE may function as an oxidizer and a binder in the composition. The PFPE may be curable and cross-linkable, such as with a curative, as described in more detail below. The PFPE may have the chemical structure of $HO(CH_2CH_2O)_nCH_2CF_2O(CF_2CF_2O)_p(CF_2O)_qCF_2CH_2(OCH_2CH_2)_nOH$, where n is an integer between 0 and 10, p is an integer between 0 and 50, and q is an integer between 0 and 50. By way of example only, the PFPE may be FLUOROLINK® PFPE E10-H, which has a fluorine content of about 57% by weight of the PFPE and is commercially available from Solvay Solexis SpA (Milan, Italy). In one embodiment, the PFPE is FLUOROLINK® PFPE E10-H and has a chemical structure of $HO(CH_2CH_2O)_nCH_2CF_2O(CF_2CF_2O)_p(CF_2O)_qCF_2CH_2(OCH_2CH_2)_nOH$, where n is an integer between 0 and 10, p is an integer between 0 and 50, and q is an integer between 0 and 50.

A PFPE exhibiting different properties may be used in the composition, such as a PFPE having different terminal functional groups, a different fluorine content, a different molecular weight, etc. than the FLUOROLINK® PFPE E10-H. The PFPE may be a liquid at room temperature and at a processing temperature of the composition and may function as an oxidizer and a binder in the composition. The PFPE may be curable and cross-linkable. The PFPE may be a bifunctional compound having the chemical structure of $R_H$—$CF_2O$—$(CF_2CF_2O)_m$—$(CF_2O)_nCF_2$—$R_H$, where $R_H$ is the terminal functional group, m is an integer between 1 and 50, and n is an integer between 1 and 50. The terminal functional group on the PFPE may include, but is not limited to, an acrylate, an alcohol, an alkyl amide, an alkoxy silane, an amide, an amido silane, an ester, an ethoxylated alcohol, a urethane (e.g., a (meth)acrylate), a phosphate, a phosphate dispersion, or a combination thereof. The terminal functional group does not include (e.g., excludes) a carboxylic acid (—COOH) group. Alternatively, the PFPE may have the chemical structure of $HOCH_2CFCF_3OCF_2CF_2CF_2CF_2CF_2CH_2CF_2OCF_2CF_2OCF_3CFCF_2OCF_3$—$CFCF_2OCF_3CFCH_2OH$.

The fluorine content of the PFPE may range from about 20 wt % to about 70 wt % of the PFPE, such as from about 20 wt % to about 25 wt % of the PFPE, from about 40 wt % to about 70 wt % of the PFPE, from about 45 wt % to about 70 wt % of the PFPE, from about 50 wt % to about 70 wt % of the PFPE, from about 55 wt % to about 70 wt % of the PFPE, from about 60 wt % to about 70 wt % of the PFPE, from about 40 wt % to about 55 wt % of the PFPE, from about 45 wt % to about 55 wt % of the PFPE, from about 50 wt % to about 55 wt % of the PFPE, from about 50 wt % to about 70 wt % of the PFPE, from about 55 wt % to about 70 wt % of the PFPE, from about 60 wt % to about 70 wt % of the PFPE, or from about 65 wt % to about 70 wt % of the PFPE. In some embodiments, the fluorine content is about 68 wt % of the PFPE. In other embodiments, the fluorine content is about 62 wt % of the PFPE. In yet other embodiments, the fluorine content is about 65.6 wt % of the PFPE.

The PFPE having the chemical structure of $R_H$—$CF_2O$—$(CF_2CF_2O)_m$—$(CF_2O)_n$—$CF_2$—$R_H$ or of $HOCH_2CFCF_3OCF_2CF_2CF_2CF_2CH_2CF_2OCF_2CF_2OCF_3CFCF_2OCF_3CFCF_2OCF_3$—$CFCH_2OH$ may also be used in combination with the PFPE having the chemical structure of $HO(CH_2CH_2O)_nCH_2CF_2O(CF_2CF_2O)_p(CF_2O)_qCF_2CH_2(OCH_2CH_2)_nOH$.

Examples of PFPEs that may be used in the composition are shown in Table 1, along with their chemical structures, terminal functional groups, and fluorine contents.

The PFPE may be commercially available from various sources, such as from Solvay Solexis SpA (Milan, Italy) or from 3M (St. Paul, Minn.). In other embodiments, the PFPE is FLUOROLINK® PFPE D4000, which has a fluorine content of about 68% by weight of the PFPE and is commercially available from Solvay Solexis SpA (Milan, Italy). In yet other embodiments, the PFPE is FLUOROLINK® PFPE D2, which has a fluorine content of about 62% by weight of the PFPE and is commercially available from Solvay Solexis SpA (Milan, Italy). In yet other embodiments, the PFPE is L9939, which has a fluorine content of about 65.6% by weight of the PFPE and is commercially available from 3M (St. Paul, Minn.).

The PFPE may account for from about 12 wt % to about 45 wt % of the composition, such as from about 15 wt % to about 45 wt % of the composition, from about 15 wt % to about 40 wt % of the composition, from about 15 wt % to about 35 wt % of the composition, from about 15 wt % to about 30 wt % of the composition, from about 20 wt % to about 35 wt % of the composition, from about 20 wt % to about 30 wt % of the composition, from about 25 wt % to about 35 wt % of the composition, from about 30 wt % to about 45 wt % of the composition, from about 30 wt % to about 40 wt % of the composition, or from about 23 wt % to about 26 wt % of the composition. In one embodiment, the PFPE is present in the composition at about 25 wt %. As discussed in more detail below, the amount of PFPE in the composition is sufficient to produce a composition that is castable.

A fluoropolymer in addition to the one or more PFPEs may also be present in the composition, such as polytetrafluoroethylene (PTFE), which is commercially available from DuPont under the tradename TEFLON®, a thermoplastic terpolymer of tetrafluoroethylene, hexafluoropropylene, and vinylidene fluoride (THV), a thermoplastic copolymer of tetrafluoroethylene and perfluorovinylether (PFA), a thermoplastic copolymer of tetrafluoroethylene and ethyl-

TABLE 1

Properties of PFPEs.

| PFPE Trade Name | Chemical Structure | Terminal Functional Group ($R_H$) | Fluorine Content |
|---|---|---|---|
| FLUOROLINK ® A10-P, FLUOROLINK ® PA100E | $R_H$—$CF_2O$—$(CF_2CF_2O)_m$—$(CF_2O)_n$—$CF_2$—$R_H$ | —$CONHR_H$ (alkyl amide) | 46 |
| FLUOROLINK ® S10 | $R_H$—$CF_2O$—$(CF_2CF_2O)_m$—$(CF_2O)_n$—$CF_2$—$R_H$ | —$CONH(CH_2)_3$—$Si(OEt)_3$ (ethoxy silane) | 50 |
| FLUOROLINK ® D10H | $HO(CH_2CH_2O)_{1.5}$—$CH_2CF_2C$—$(OCF_2CF_2)_n$(—$OCF_2)_m$—$OCF_2CH_2$(—$OCH_2CH_2)_{1.5}OH$ | ethoxylated alcohol | 57 |
| FLUOROLINK ® D4000 | $HOCH_2CF_2$—$(OCF_2CF_2)_n$—$(OCF_2)_m$—$OCF_2CH_2OH$ | ethoxylated alcohol | 68 |
| FLUOROLINK ® D2 | $HOCH_2CF_2$—$(OCF_2CF_2)_n$—$(OCF_2)_m$—$OCF_2CH_2OH$ | ethoxylated alcohol | 62 |
| FLUOROLINK ® AD1700 | $R_H$—$CF_2O$—$(CF_2CF_2O)_m$—$(CF_2O)_n$—$CF_2$—$R_H$ | —$COOCR_H$=$CH_2$ (acrylate) | 24 (dry) |
| FLUOROLINK ® MD700 | $R_H$—$CF_2O$—$(CF_2CF_2O)_m$—$(CF_2O)_n$—$CF_2$—$R_H$ | —$COOCR_H$=$CH_2$ ((meth)acrylate) | 52 |
| FLUOROLINK ® MD40 | $R_H$—$CF_2O$—$(CF_2CF_2O)_m$—$(CF_2O)_n$—$CF_2$—$R_H$ | —$COOCR_H$=$CH_2$ | 58 |
| FLUOROLINK ® P54, FLUOROLINK ® F10 | $R_H$—$CF_2O$—$(CF_2CF_2O)_m$—$(CF_2O)_n$—$CF_2$—$R_H$ | —$R_HOPO(OH)_2$ (phosphate dispersion) | 48 |
| L9939 | $HOCH_2CFCF_3OCF_2CF_2CF_2CF_2CH_2CF_2OCF_2CF_2OCF_3CFCF_2OCF_3CFCF2OCF_3CFCH_2$-OH | hydroxyl | 65.62 |

ene (ETFE), or a thermoplastic copolymer of tetrafluoroethylene and hexafluoropropylene (FEP). The additional fluoropolymer may be a solid or a liquid. In one embodiment, the addition fluoropolymer is PFTE. By way of example only, micronized PTFE, such as that commercially available under the Fluo tradename from Micro Powders, Inc. (Tarrytown, N.Y.), may be used in the composition. In one embodiment, the micronized PTFE is Fluo HT-G available from Micro Powders, Inc. (Tarrytown, N.Y.). The Fluo HT-G micronized PTFE has a mean particle size of between about 2 μm and about 4 μm, with a maximum particle size of 12 μm. However, other grades of micronized PTFE commercially available under the Fluo tradename may also be used. The additional fluoropolymer, if present, may account for from about 0.1 wt % to about 25 wt % of the composition, such as from about 2.5 wt % to about 25 wt % of the composition. In some embodiments, PTFE is present in the composition at about 6.66 wt %. In one embodiment, the micronized PTFE is present in the composition at about 6.66 wt %. In another embodiment, the micronized PTFE is present in the composition at about 5.66 wt %. In yet another embodiment, the micronized PTFE is present in the composition at about 4.00 wt %. The micronized PTFE may provide an additional source of fluorine and oxygen to the composition, in addition to maintaining the composition as a homogeneous material and controlling a burn rate of the composition.

The composition may also include a curative that includes, but is not limited to, an isocyanate compound, such as a diisocyanate, a polyisocyanate, or combinations thereof. By way of example only, the isocyanate may be hexamethylene diisocyanate (HMDI), isophorone diisocyanate (IPDI), dimeryl diisocyanate (DDI), tetramethylxylylene diisocyanate (TMXDI), octadecyl isocyanate (ODI), or combinations thereof, as well as water condensation reaction products thereof. During cure, isocyanate functional groups of the curative react with hydroxyl or other functional groups on the PFPE to form urethane linkages. The curative may be selected depending on the terminal functional groups present in the PFPE. In one embodiment, the curative is a mixture of IPDI and a polyisocyanate based on HMDI, such as DESMODUR® N100, where relative amounts of IPDI and DESMODUR® N100 may be varied depending on desired mechanical properties of the grains. DESMODUR® N100 is commercially available from Bayer MaterialScience (Pittsburgh, Pa.). In other embodiments, the curative includes DPI and ODI. A trifunctional alcohol, such as trimethylolpropane ethoxylate (TMPE) or triethylene glycol, may also be used as a crosslinking agent in combination with HMDI, IPDI, DDI, TMXDI, or combinations thereof. In another embodiment, the curative is a mixture of IPDI and TMPE, where the TMPE has an average molecular weight of about 170 amu. However, higher or lower molecular weights of TMPE may be used, such as TMPE having an average molecular weight of about 450 amu. The amount of curative in the composition may be selected based on the amount of PFPE used. By way of example only, the curative may be present in the composition at from about 1 wt % to about 40 wt %, from about 1 wt % to about 20 wt %, from about 1 wt % to about 15 wt %, from about 1 wt % to about 10 wt %, or from about 3 wt % to about 8 wt %. In embodiments where TMPE is used in combination with the isocyanate compound, the TMPE may be present in the composition at from about 0.1 wt % to about 10 wt %, such as from about 0.1 wt % to about 5 wt % or from about 0.1 wt % to about 4 wt %. The triethylene glycol may be present in the composition at from about 0.1 wt % to about 10 wt %. In some embodiments, the crosslinking agent is triethylene glycol.

Optional additives may be used in the composition to provide at least one of improved processing, improved sensitivity to ignition (thermal, electrostatic, friction, impact), and improved energetic performance to the composition. The optional additive may be a plasticizer, an electrostatic discharge (ESD) agent, a cure catalyst, a carbon generator, a surfactant, a carbon additive, a burn rate catalyst, a metal chelator, a potlife extender, or combinations thereof. Each of the additives may provide one or more functions to the composition. The additives, if present, may account for less than about 12% of the composition, such as less than or equal to about 10% of the composition or less than or equal to about 5% of the composition. The plasticizer may include, but is not limited to, octadecyl isocyanate (ODI) and, if present, may account for from about 0.1 wt % to about 1 wt % of the composition.

The electrostatic discharge agent may be a conductive carbon black, such as BLACK PEARL® carbon black, which is commercially available from Cabot Corporation (Pampa, Tex.). If present, the electrostatic discharge agent may account for from about 0.05 wt % to about 0.5 wt % of the composition, such as from about 0.05 wt % to about 0.25 wt % of the composition. In some embodiments, the electrostatic discharge agent is a conductive carbon black. The cure catalyst may be triphenyl tin chloride (TPTC), triphenyl bismuth (TPB), dibutyltin dilaurate (DBTDL), or iron acetylacetonate. The cure catalyst may be selected based on other ingredients of the composition, such as the curative or the PFPE. The cure catalyst, if present, may account for from about 0.001 wt % to about 0.2 wt % of the composition, such as from about 0.005 wt % to about 0.1 wt % of the composition. In some embodiments, the cure catalyst is TPTC.

The carbon additive, if present, may account for from about 0.1 wt % to about 10 wt % of the composition, such as from about 1 wt % to about 5 wt % of the composition. The carbon generator may be phenolphthalein (phth), anthracene, naphthalene, decacyclene, an anthraquinone, or a polyolefin and, if present, may account for from about 1 wt % to about 15 wt % of the composition, such as from about 1 wt % to about 5 wt % of the composition. In some embodiments, the carbon generator is phenolphthalein. The surfactant may be a fluorosurfactant, such as a nonionic polymeric fluorosurfactant. The fluorosurfactant may be NOVEC® FC-4432 fluorosurfactant, which is commercially available from 3M Co. (St. Paul, Minn.). The surfactant, if present, may account for from about 0.01 wt % to about 0.5 wt % of the composition, such as from about 0.1 wt % to about 0.3 wt % of the composition.

The burn rate catalyst may include, but is not limited to, boron, iron oxide ($Fe_2O_3$), cupric oxide (CuO), potassium ferricyanide ($K_3[Fe(CN)_6]$), or a combination thereof. The potassium ferricyanide, if present, may also function as a potlife extender. In some embodiments, the burn rate catalyst is boron. In some embodiments, the burn rate catalyst is iron oxide. In yet other embodiments, the burn rate catalyst is potassium ferricyanide. The burn rate catalyst, if present, may account for from about 0.01 wt % to about 5.00 wt % of the composition, such as from about 0.01 wt % to about 3.00 wt % of the composition, from about 0.05 wt % to about 1.50 wt % of the composition, or from about 0.05 wt % to about 0.50 wt % of the composition. If boron is present in the composition, the boron may be present in an amount sufficient to function as a burn rate catalyst. The metal chelator may include, but is not limited to, tris(nonylphenyl) phosphite, which is commercially available as WESTON® 399 from Addivant Corp. (Danbury, Conn.). The metal chelator may be present at from about 0.01 wt % to about 1.00 wt % of the composition, such as from about 0.15 wt % to about 0.50 wt % of the composition. The metal chelator may inhibit the catalytic reaction of cure of the composition, such as by reacting with a surface of a metal in the composition. The metal chelator, if present, may also function as a potlife extender. In some embodiments, the metal chelator is tris(nonylphenyl)phosphite.

In some embodiments, the composition includes an alloy of 50 wt % magnesium and 50 wt % aluminum, FLUOROLINK® PFPE E10-H, a curative, and micronized PTFE. In some embodiments, the curative is IPDI and DESMODUR® N100. In other embodiments, the curative is IPDI and TMPE. Embodiments of the composition optionally include at least one of ODI, carbon black, TPTC or TPB, phth, and NOVEC® FC-4432 fluorosurfactant.

The composition may be prepared by combining the fuel, the PFPE, the curative, and any optional additives. The ingredients may be mixed in a low shear environment and at a temperature of from room temperature to about 150° F. (about 65.6° C.), such as at about 135° F. (about 57.2° C.). Since the PFPE is a liquid at the processing temperature, the ingredients of the composition may be combined with mixing and without the addition of solvents. Also, since no solvents are present, vacuum mixing may be used to prepare the composition. A mixer that provides the low shear environment, such as a Baker Perkins mixer, may be used to prepare the composition. In contrast, a Muller mixer, which provides a high shear environment, is needed to prepare conventional MTV compositions. By tailoring the amount of the PFPE in the composition, the composition may exhibit a viscosity sufficient for the composition to be cast into grains of a desired geometry. By way of example only, the resulting composition may have a viscosity of less than about 40 kP at 135° F. (about 57.2° C.), such as less than or equal to about 25 kP at 135° F., less than or equal to about 15 kP at 135° F., such as less than or equal to about 10 kP at 135° F., such as less than or equal to about 8 kP at 135° F., less than or equal to about 7 kP at 135° F., less than or equal to about 6 kP at 135° F., or less than or equal to about 5 kP at 135° F.

Thus, the composition is prepared by a solvent-less process. Since no solvents are used, a solvent removal process, such as drying or solvent evaporation, is not needed before forming the composition into the grains. Once prepared, the composition may be cast into a casing or mold and cured into grains having the desired geometry. Since the composition may be cast into the grains, high pressure pressing or extrusion are not needed to form the grains, in contrast to forming grains from conventional MTV compositions. By way of example only, low pressure casting techniques may be used, such as vacuum casting or displacement casting, to form the composition into the desired geometry. The compositions according to embodiments of the disclosure may exhibit increased potlife compared to conventional MTV compositions. Therefore, a period of time is increased in which the compositions according to embodiments of the disclosure may be cast prior to curing. Complex grain geometries may be achieved by casting the composition according to embodiments of the disclosure. Therefore, no post-machining of the grains formed from the compositions according to embodiments of the disclosure is needed. The ability to cast the composition enables the desired grain geometries to be produced by processing techniques that are less time intensive and safer than methods of producing conventional MTV compositions. The compositions according to embodiments of the disclosure may be produced and configured into grains at lower temperatures and substantially lower pressures than conventional MTV compositions. The compositions are configured into the grains without decreasing performance properties of the compositions. Once cured, the grain can be removed from the casing or mold and loaded into a flare by conventional techniques.

The compositions according to embodiments of the disclosure may exhibit decreased sensitivity to ignition during formation and casting into the grains compared to the processing of conventional MTV compositions, which requires high temperatures and high pressures during pressing and extrusion. When conventional MTV compositions are pressed into grains, a pressure of from about 5000 psi (about 34.5 MPa) to about 10000 psi (about 68.9 MPa) and a temperature of from about 65° C. to about 94° C. are used. When conventional MTV compositions are extruded into grains, a pressure of from about 2000 psi (about 13.8 MPa) to about 5000 psi (about 34.5 MPa) and a temperature of from about 93° C. to about 177° C. are used. In contrast, the compositions according to embodiments of the disclosure are configured into grains at a pressure of less than or equal to about 1 atm (less than or equal to about 10 psi, less than or equal to about 1.013 hectopascal) and at a temperature of from about 37° C. to about 72° C., such as from about 37° C. to about 66° C. or from about 37° C. to about 60° C. Therefore, the compositions according to embodiments of the disclosure are less hazardous to produce and to configure into grains than conventional MTV compositions. The addition of additives, such as boron, potassium ferricyanide, iron oxide, or combinations thereof, was found to improve the processability of the compositions according to embodiments of the disclosure. However, the compositions according to embodiments of the disclosure may be ignited and exhibit desired performance properties of a flare composition.

The compositions according to embodiments of the disclosure may also exhibit comparable or improved aging compared to that of conventional MTV compositions. By including the PFPE in the composition and casting the composition into grains, the grains may exhibit decreased off-gassing, which decreases their degradation during storage. In contrast, off-gassing of conventional MTV compositions produces hydrogen gas and water, which may react with reactive components in the MTV composition. Without being bound by any theory, it is believed that the comparable or improved aging of the compositions according to embodiments of the disclosure is achieved by encapsulating reactive components of the composition, such as the fuel, with the PFPE.

Casting the composition according to embodiments of the disclosure into the grains may also improve the energetic performance of the composition. The grains formed by casting may have a high surface area and exhibit improved ignition compared to grains formed of conventional MTV compositions that are pressed or extruded. Thus, although the composition according to embodiments of the disclosure includes a relatively large amount of PFPE as the binder, the grains formed from the composition were, unexpectedly, more easily ignited than the grains formed from conventional MTV compositions by pressing or extrusion. The compositions according to embodiments of the disclosure may also exhibit comparable or increased sensitivity to ignition, such as increased sensitivity to thermal, electrostatic, friction, or impact stimuli, compared to that of conventional MTV compositions. Without being bound by any theory, it is believed that the improved sensitivity is achieved by encapsulating reactive materials of the composition, such as the fuel, with the PFPE.

The compositions according to embodiments of the disclosure may also exhibit comparable or improved intensity, burn time, and rise time compared to conventional MTV compositions. The intensity of the compositions according to embodiments of the disclosure may be greater than or about equivalent to (i.e., at least about 95% of) the intensity of a conventional MTV composition. The burn time of the compositions according to embodiments of the disclosure may be from about 1.5 times to about 2 times greater than that of a conventional MTV composition. The rise rate is the amount of time elapsed from deployment of the decoy flare from an aircraft to when the combusting flare composition exhibits full spectral intensity. The rise time of the compositions according to embodiments of the disclosure may be greater than or about equivalent to (i.e., at least about 95% of) that of a conventional MTV composition.

The compositions according to embodiments of the disclosure unexpectedly exhibited comparable or improved energetic performance compared to conventional MTV compositions that are pressed or extruded into grains. The amount of the PFPE in the compositions according to embodiments of the disclosure was expected to decrease the burn rates of the compositions to a point that the desired IR intensity could not be achieved. However, the IR intensity of the compositions according to embodiments of the disclosure was found, unexpectedly, to be equivalent to that of the conventional MTV compositions. The compositions according to embodiments of the disclosure also unexpectedly exhibited reduced sensitivity to electrostatic discharge and reduced off-gassing compared to conventional MTV compositions.

Embodiments of the compositions of the disclosure may be used as a drop-in replacement for the grain (i.e., flare composition, payload) of a conventional decoy flare, such as a decoy flare having a form factor of 1×1×8 inches, 1×2×8 inches, 2×2.5 inches, 36 mm round, or kinematic in the same form factors as previously listed. Examples of such decoy flares are known in the art and may be referred to as M206, M212, MJU-8A/B, MJU-10, MJU-23B, MJU-32, MJF-47, MJU-53, MJU-62B, MJU-61, MJU-71, MJU-32, MJU-47, or MJU-59 decoy flares. Thus, the decoy flares may be characterized as a "modified" M212, MJU-62B, MJU-10, MJU-59, or MJU-67 flare in that the grain of a conventional decoy flare is replaced with a composition according to an embodiment of the disclosure.

The composition may be used in a flare. FIG. 1 illustrates a flare 10, such as a decoy flare, that includes grain 22 (i.e., flare composition, payload) formed from a composition according to an embodiment of the disclosure. The grain 22 is contained in a casing 12 of the flare 10. The casing 12 may have a first end 14, i.e., the aft end, from which an aft end 23A of the grain 22 is ignited, and a second end 16, i.e., the forward end opposite from the aft end, from which the grain 22 is ejected upon ignition. For simplicity, an igniter for igniting the grain 22 is not shown in FIG. 1. The flare 10 also includes an end cap 40 that is attached to a forward end 23B of the grain 22.

The following examples serve to explain embodiments of the disclosure in more detail. These examples are not to be construed as being exhaustive or exclusive as to the scope of this disclosure.

EXAMPLES

Example 1

Formulations of Compositions A-M and O-Q

Figure 2:
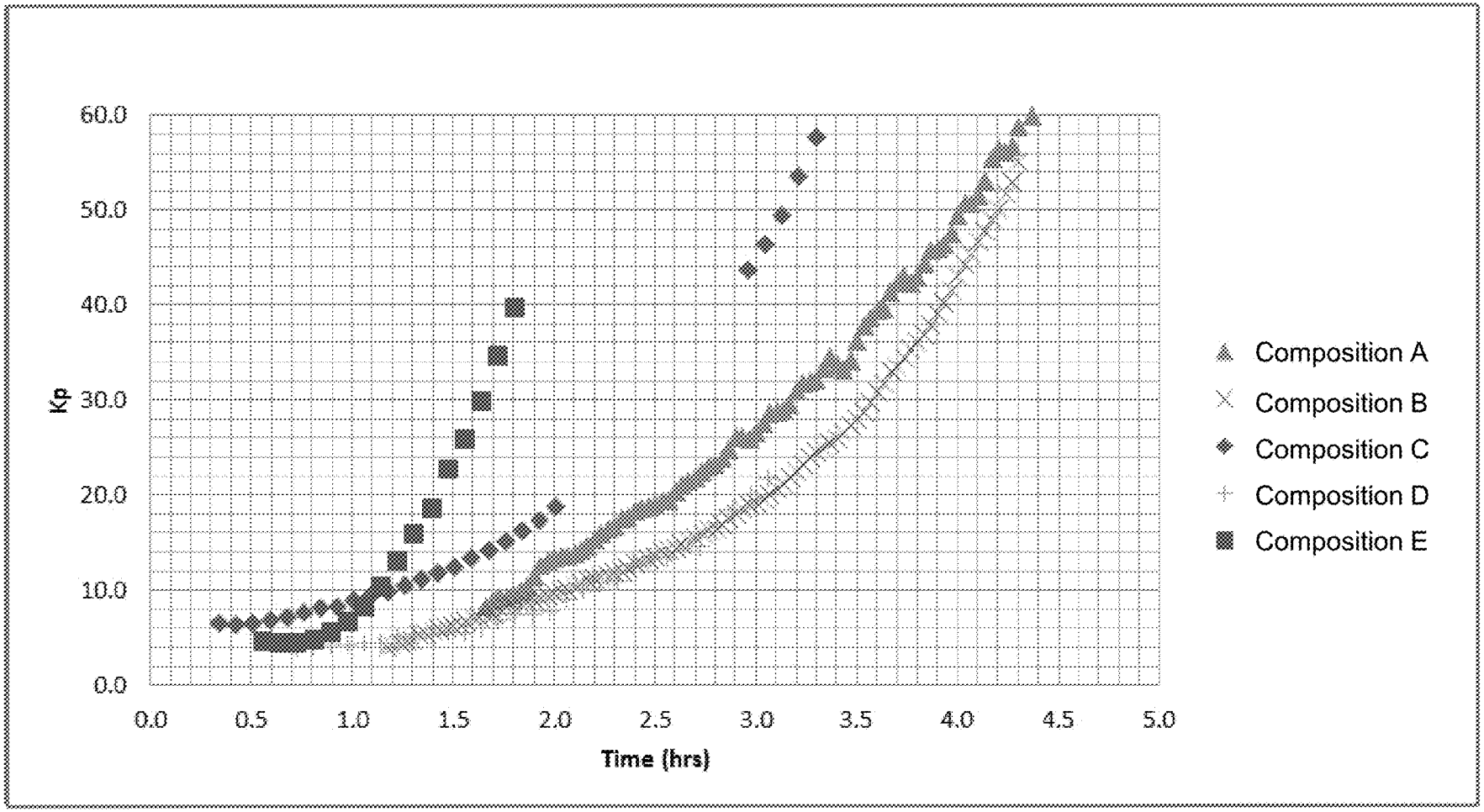
FIG. 2 is a plot of viscosity as a function of time for compositions according to embodiments of the disclosure.

Embodiments of compositions according to the disclosure were produced and included the ingredients shown in Table 2. Each of the ingredients was commercially available, and was purchased from a commercial source including, but not limited to, Reade Advanced Materials, Cabot Corporation, Solvay Solexis SpA, Micro Powders, Inc., Bayer Material Science, Sigma-Aldrich Corp., BASF Corp., etc. The ingredients of each composition were added to a Baker Perkins mixer and combined in a low shear environment to produce each composition. The end of mix (EOM) viscosity of many of the compositions was measured by conventional techniques and is included in Table 3. Following cure, a plot of viscosity as a function of cure time for Compositions A-E is shown in FIG. 2.

TABLE 2

Formulations of Compositions A-M and O-Q.

| Ingredient | Comp. | | | | | | | |
|---|---|---|---|---|---|---|---|---|
| (wt %) | A | B | C | D | E | F | G | H |
| MgAl alloy[a] | 59.91 | 59.87 | 59.77 | 58.77 | 59.10 | 57.62 | 57.62 | 57.37 |
| PFPE[b] | 25 | 25 | 25 | 25.85 | 25.85 | 23.50 | 23.50 | 23.50 |
| IPDI/N100[c] | 5 | 5 | 5 | 5.15 | 5.15 | — | — | — |
| IPDI | — | — | — | — | — | 7 | 7 | 7 |
| N100 | — | — | — | — | — | — | — | — |
| ODI | 0.25 | 0.25 | 0.25 | 0.25 | — | — | — | 0.25 |
| Micronized PTFE[d] | 6.66 | 6.66 | 6.66 | 6.66 | 6.30 | 6.66 | 6.66 | 6.66 |
| Carbon black[e] | 0.1 | 0.1 | 0.15 | 0.15 | — | 0.1 | 0.1 | 0.1 |
| TPTC | 0.005 | — | — | — | — | 0.005 | 0.005 | 0.005 |
| TPB | — | 0.05 | 0.1 | 0.1 | 0.1 | — | — | — |
| Phth | 3.075 | 3.075 | 3.075 | 3.075 | 3.5 | 3.08 | 3.08 | 3.08 |
| TMPE[f] | — | — | — | — | — | 1.79 | 1.79 | 1.79 |
| Fluoro-surfactant[g] | — | — | — | — | — | 0.25 | 0.25 | 0.25 |
| Total | 100 | 100 | 100 | 100 | 100 | 100 | 100 | 100 |

TABLE 2-continued

Formulations of Compositions A-M and O-Q.

| Ingredient | Comp. | | | | | | | |
|---|---|---|---|---|---|---|---|---|
| (wt %) | I | J | K | L | M | O | P | Q |
| MgAl alloy[a] | 57.87 | 57.56 | 58.64 | 57.52 | 59.25 | 57.87 | 61.9 | 59.82 |
| PFPE[b] | 23.50 | 25 | 25 | 25 | 25 | 23.5 | 23.5 | 23.5 |
| IPDI/N100[c] | — | — | — | — | — | — | — | — |
| IPDI | 7 | 7.45 | 7.45 | 7.45 | 7.45 | 7 | 3.85 | 5.25 |
| N100 | — | — | — | — | — | — | — | — |
| ODI | — | — | — | — | — | 0.5 | 0.5 | 0.5 |
| Micronized PTFE[d] | 6.66 | 5.66 | 6.66 | 5.66 | 4.00 | 6.66 | 6.66 | 6.66 |
| Carbon black[e] | 0.1 | 0.1 | 0.1 | 0.1 | 0.10 | 0.1 | 0.1 | 0.1 |
| TPTC | 0.005 | 0.005 | 0.005 | — | 0.005 | 0.005 | 0.005 | 0.005 |
| TPB | — | — | — | 0.05 | — | — | — | — |
| Phth | 3.08 | 2.08 | — | 2.08 | 2.00 | 3.075 | 3.075 | 3.075 |
| TMPE[f] | 1.79 | 1.90 | 1.90 | 1.90 | 1.90 | 1.29 | 0.16 | 0.84 |
| Fluoro-surfactant[g] | — | 0.25 | 0.25 | 0.25 | 0.25 | — | 0.25 | 0.25 |
| Total | 100 | 100 | 100 | 100 | 99.95 | 100 | 100 | 100 |

[a]alloy of 50% magnesium and 50% aluminum
[b]FLUOROLINK ® E10-H polyfluoropolyether
[c]isophorone diisocyanate and DESMODUR ® N100
[d]Fluo HT-G
[e]BLACK PEARL ® carbon black
[f]TMPE having an average $M_n$ ~170
[g]NOVEC ® FC-4432 fluorosurfactant

TABLE 3

Viscosities for Compositions A-M.

| | Composition | | | | | | | | | | | | |
|---|---|---|---|---|---|---|---|---|---|---|---|---|---|
| | A | B | C | D | E | F | G | H | I | J | K | L | M |
| EOM Viscosity (kP at 135° F.) | 8 | 7 | 6.1 | 5.6 | 4.7 | 5.6 | NT | 12.5 | 12.2 | NT | 9 | 35 | NT |

NT = not tested

Example 2

Performance Data

Compositions A-M described in Table 2 were cast into grains and the grains were tested in 1×1×8 inches form factors at T-2 wind stream under 120 knot blow-down to determine their performance. For comparison, 1×1×8 inches form factors including a conventional MTV composition were also tested. The conventional MTV composition was extruded or pressed into grains that were loaded into the form factors. The performance testing was conducted by conventional techniques, which are not described in detail herein. The form factors having compositions A-M had comparable or greater burn times compared to the form factors with the conventional MTV composition, while maintaining comparable or equivalent intensities and rise times as the conventional MTV composition.

Each of compositions O-Q described in Table 2 is cast into grains, and the grains are tested in 1×1×8 inches form factors at T-2 wind stream under 120 knot blow-down to determine their performance. For comparison, 1×1×8 inches form factors including a conventional MTV composition are also tested. The conventional MTV composition is extruded or pressed into grains that are loaded into the form factors. The performance testing is conducted by conventional techniques, which are not described in detail herein. The form factors having compositions O-Q have comparable or greater burn times compared to the form factors with the conventional MTV composition, while maintaining comparable or equivalent intensities and rise times as the conventional MTV composition.

Figure 3:
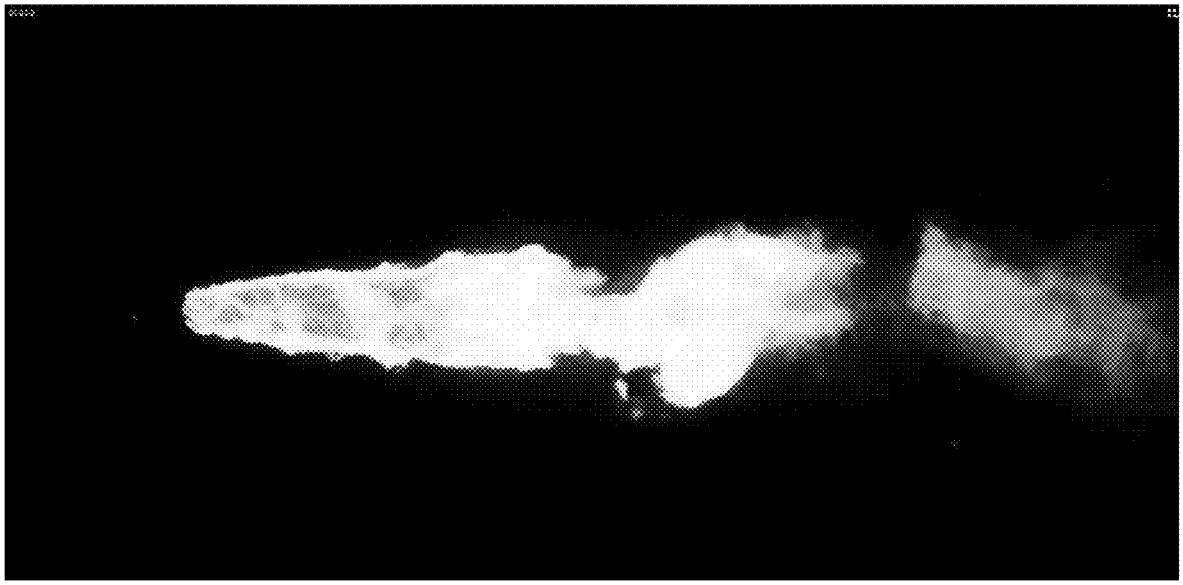
FIG. 3 is a photograph of a form factor subjected to wind stream testing and including a composition according to an embodiment of the disclosure.

A photograph of a form factor including Composition A tested in the wind stream testing is shown in FIG. 3.

Example 3

Formulations of Additional PFPE Compositions

Embodiments of compositions according to the disclosure are produced and include the ingredients shown in Table 4. The PFPE is one of the PFPEs listed in Table 1, such as FLUOROLINK® D10H, FLUOROLINK® D4000, FLUOROLINK® D2, L9939, or a combination thereof. Each of the ingredients is commercially available, and is purchased from a commercial source including, but not limited to, Reade Advanced Materials, Cabot Corporation, Solvay Solexis SpA, Micro Powders, Inc., Bayer Material Science, Sigma-Aldrich Corp., BASF Corp., 3M, Addivant Corp., etc. The ingredients of each composition are added to a Baker Perkins mixer and combined in a low shear environment to produce each composition.

TABLE 4

Formulations of PFPE Compositions.

| Formulation | PFPE (wt %) | Fuel (wt %) | Curative (wt %) | Additional Fluoropolymer (wt %) | ESD Agent (wt %) | Carbon Generator/ Additive (wt %) | Cure Catalyst (wt %) | Metal Chelator (wt %) | Crosslinking Agent (wt %) | Burn Rate Catalyst (wt %) |
|---|---|---|---|---|---|---|---|---|---|---|
| 1 | 15-45 FLUOROLINK ® A10-P, PA100E | 20-70 | 0-15 | 0-25 | 0-0.25 | 0-15 | 0-0.2 | 0-1 | 0-10 | 0-5 |
| 2 | 15-45 FLUOROLINK ® S10 | 20-70 | 0-15 | 0-25 | 0-0.25 | 0-15 | 0-0.2 | 0-1 | 0-10 | 0-5 |
| 3 | 15-45 FLUOROLINK ® D10-H | 20-70 | 0-15 | 0-25 | 0-0.25 | 0-15 | 0-0.2 | 0-1 | 0-10 | 0-5 |
| 4 | 15-45 FLUOROLINK ® D4000 | 20-70 | 0-15 | 0-25 | 0-0.25 | 0-15 | 0-0.2 | 0-1 | 0-10 | 0-5 |
| 5 | 15-45 FLUOROLINK ® D2 | 20-70 | 0-15 | 0-25 | 0-0.25 | 0-15 | 0-0.2 | 0-1 | 0-10 | 0-5 |
| 6 | 15-45 FLUOROLINK ® AD1700 | 20-70 | 0-15 | 0-25 | 0-0.25 | 0-15 | 0-0.2 | 0-1 | 0-10 | 0-5 |
| 7 | 15-45 FLUOROLINK ® MD700 | 20-70 | 0-15 | 0-25 | 0-0.25 | 0-15 | 0-0.2 | 0-1 | 0-10 | 0-5 |
| 8 | 15-45 FLUOROLINK ® MD40 | 20-70 | 0-15 | 0-25 | 0-0.25 | 0-15 | 0-0.2 | 0-1 | 0-10 | 0-5 |
| 9 | 15-45 FLUOROLINK ® P54 | 20-70 | 0-15 | 0-25 | 0-0.25 | 0-15 | 0-0.2 | 0-1 | 0-10 | 0-5 |
| 10 | 15-45 FLUOROLINK ® F10 | 20-70 | 0-15 | 0-25 | 0-0.25 | 0-15 | 0-0.2 | 0-1 | 0-10 | 0-5 |
| 11 | 15-45 L9939 | 20-70 | 0-15 | 0-25 | 0-0.25 | 0-15 | 0-0.2 | 0-1 | 0-10 | 0-5 |

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the scope of the following appended claims and their legal equivalents.

What is claimed is:

1. A composition, comprising:

a fuel comprising one or more of aluminum, bismuth, copper, iron, hafnium, magnesium, palladium, tantalum, tin, titanium, zinc, zirconium, or an alloy thereof;

a perfluoropolyether (PFPE) comprising a chemical structure of $R_H$—$CF_2O$—$(CF_2CF_2O)_m$—$(CF_2O)_n$—$CF_2$—$R_H$, wherein $R_H$ is a functional group selected from the group consisting of an acrylate, an alcohol, an alkyl amide, an alkoxy silane, an amide, an amido silane, an ester, an ethoxylated alcohol, methacrylate, a methoxy, a phosphate, and a phosphate dispersion, m is an integer between 1 and 50, and n is an integer between 1 and 50; and an isocyanate compound, the PFPE comprising from about 15% by weight (wt %) to about 45 wt % of the composition.

2. The composition of claim 1, wherein the PFPE comprises a fluorine content of from about 20 wt % to about 70 wt % of the PFPE.

3. The composition of claim 1, wherein the PFPE comprises a fluorine content of from about 20 wt % to about 25 wt % of the PFPE.

4. The composition of claim 1, wherein the PFPE comprises a fluorine content of from about 40 wt % to about 55 wt % of the PFPE.

5. The composition of claim 1, wherein the PFPE comprises a fluorine content of from about 55 wt % to about 70 wt % of the PFPE.

6. The composition of claim 1, wherein the PFPE comprises a fluorine content of from about 60 wt % to about 70 wt % of the PFPE.

7. The composition of claim 1, wherein the functional group comprises an ethoxy silane group.

8. The composition of claim 1, further comprising boron.

9. The composition of claim 1, further comprising at least one of boron, phosphorous, or silicon.

10. The composition of claim 1, further comprising at least one of potassium ferricyanide, cupric oxide, or iron oxide.

11. The composition of claim 1, wherein the composition comprises magnesium, the PFPE, isophorone diisocyanate, octadecyl isocyanate, PTFE, conductive carbon, phenolphthalein, triphenyl tin chloride, a metal chelator, triethylene glycol, boron, iron oxide, and potassium ferricyanide.

12. A composition, comprising:

a fuel;

a perfluoropolyether (PFPE) comprising a chemical structure of $HOCH_2CFCF_3OCF_2CF_2CF_2CF_2$—$CH_2CF_2OCF_2CF_2OCF_3CFCF_2OCF_3CFCF_2OCF_3CFCH_2OH$; and an isocyanate compound, the PFPE comprising from about 15% by weight (wt %) to about 45 wt % of the composition and the fuel comprising from about 45% wt % to about 70 wt % of the composition.

13. The composition of claim 12, wherein the PFPE comprises a fluorine content of about 60 wt % to about 70 wt %.

14. The composition of claim 12, wherein the fuel comprises from about 50% wt % to about 70 wt % of the composition.

15. The composition of claim 12, wherein the fuel comprises aluminum, bismuth, copper, iron, hafnium, magnesium, nickel, palladium, tantalum, tin, titanium, zinc, zirconium, an alloy thereof, or a combination thereof.

16. The composition of claim 12, wherein the fuel comprises magnesium and aluminum.

17. A countermeasure device comprising a casing and a flare composition within the casing, the flare composition comprising:

a fuel comprising one or more of aluminum, bismuth, copper, iron, hafnium, magnesium, palladium, tantalum, tin, titanium, zinc, zirconium, or an alloy thereof;

a perfluoropolyether (PFPE) comprising a chemical structure of $R_H—CF_2O—(CF_2CF_2O)_m—(CF_2O)_n—CF_2—R_H$, wherein $R_H$ is a functional group selected from the group consisting of an acrylate, an alcohol, an alkyl amide, an alkoxy silane, an amide, an amido silane, an ester, an ethoxylated alcohol, methacrylate, a methoxy, a phosphate, and a phosphate dispersion, m is an integer between 1 and 50, and n is an integer between 1 and 50; and an isocyanate compound, the PFPE comprising from about 15% by weight (wt %) to about 45 wt % of the composition.

18. A method of forming grains of a countermeasure device, comprising:

forming a flare composition comprising a fuel comprising one or more of aluminum, bismuth, copper, iron, hafnium, magnesium, palladium, tantalum, tin, titanium, zinc, zirconium, or an alloy thereof, an isocyanate compound, and perfluoropolyether (PFPE) comprising a chemical structure of $R_H—CF_2O—(CF_2CF_2O)_m—(CF_2O)_n—CF_2—R_H$, wherein $R_H$ is a functional group selected from the group consisting of an acrylate, an alcohol, an alkyl amide, an alkoxy silane, an amide, an amido silane, an ester, an ethoxylated alcohol, methacrylate, a methoxy, a phosphate, and a phosphate dispersion, m is an integer between 1 and 50, and n is an integer between 1 and 50, the PFPE comprising from about 15% by weight (wt %) to about 45 wt % of the composition; and casting the flare composition into grains.

19. The method of claim 18, wherein casting the flare composition into grains comprises casting the grains at a temperature of from about 22° C. to about 65.6° C.

20. A composition, comprising:

a fuel comprising magnesium and aluminum;

a perfluoropolyether (PFPE) comprising a chemical structure of $R_H—CF_2O—(CF_2CF_2O)_m—(CF_2O)_n—CF_2—R_H$, wherein $R_H$ is a functional group selected from the group consisting of an acrylate, an alcohol, an alkyl amide, an alkoxy silane, an amide, an amido silane, an ester, an ethoxylated alcohol, a methacrylate, a methoxy, a phosphate, and a phosphate dispersion, m is an integer between 1 and 50, and n is an integer between 1 and 50; and an isocyanate compound, the PFPE comprising from about 15% by weight (wt %) to about 45 wt % of the composition.

* * * * *